US005549125A

United States Patent [19]

White

[11] Patent Number: 5,549,125

[45] Date of Patent: Aug. 27, 1996

[54] RELATING TO SMOKING ARTICLES

[75] Inventor: Peter R. White, Romsey, England

[73] Assignee: British-American Tobacco Company Limited, Middlesex, England

[21] Appl. No.: 354,448

[22] Filed: Dec. 12, 1994

Related U.S. Application Data

[63] Continuation of Ser. No. 083,550, Jun. 28, 1993, abandoned.

[30] Foreign Application Priority Data

Jul. 4, 1992 [GB] United Kingdom ..... 9214267

[51] Int. Cl.[6] ..... A24D 3/04

[52] U.S. Cl. ..... 131/342; 131/336; 131/339; 131/344

[58] Field of Search ..... 131/331, 336, 131/339, 342, 344

[56] References Cited

U.S. PATENT DOCUMENTS

| | | | |
|---|---|---|---|
| 2,819,720 | 1/1958 | Burbig . | |
| 3,046,994 | 7/1962 | Schur | 131/342 X |
| 3,390,684 | 7/1968 | Hudnell | 131/336 |
| 3,894,545 | 7/1975 | Crellin et al. | 131/342 |
| 4,865,055 | 9/1989 | Belvederi | 131/336 X |
| 5,159,944 | 11/1992 | Arzonico et al. | 131/336 X |

FOREIGN PATENT DOCUMENTS 1533568 11/1978 United Kingdom .

*Primary Examiner*—Jennifer Bahr
*Attorney, Agent, or Firm*—Kane, Dalsimer, Sullivan, Kurucz, Levy, Eisele & Richard

[57] ABSTRACT

A cigarette having a region having means to reduce the vapour phase constituents of tobacco smoke, such as carbon, surrounding a tobacco smoke flow path is provided with ventilation means to channel the tobacco smoke away from the vapour phase constituent reducing region. The vapour phase constituent reductions achieved are greater than the reduction which would be expected in view of the degree of ventilation to which the cigarette is subjected.

13 Claims, 9 Drawing Sheets

Physical Attributes of Samples *Fig. 9.*

Basic Smoke Deliveries

Mean of Acetaldehyde and Acrolein Efficiencies

RELATING TO SMOKING ARTICLES

This application is a continuation of application Ser. No. 08/083,550, filed Jun. 28, 1993, now abandoned.

BACKGROUND OF THE INVENTION

1. Field of the Invention

The present invention relates to smoking articles and, more particularly, to smoking articles having filter elements which contain means to reduce vapour phase constituents of smoke from the smoking articles.

2. Brief Description of Related Art

The use of carbon or activated carbon in tobacco smoke filter elements to reduce vapour phase constituents of smoke has been known for some while. Commonly, carbon has been utilised either in a dual filter arrangement, the carbon granules being sprinkled onto sticky cellulose acetate tow, which tow is gathered in conventional manner and cut into double unit lengths. The double unit lengths of carbon containing acetate are then interdigitated with plain cellulose acetate filter elements having double unit lengths. The interdigitated assemblies are wrapped in plugwrap and then cut in the mid-point of both the carbon-containing filter element double unit length and the plain cellulose acetate double unit length to provide wrapped filter elements having a carbon-containing section adjacent a non carbon-containing section. This type of filter is known as an active acetate or "AA" filter.

In the alternative, carbon has been utilised in a triple filter arrangement either with the carbon being incorporated in the cellulose acetate tow, as described above, and in UK Patent Specification No. 1,087,909, or with the carbon being freely held in a cavity between two plugs of tobacco smoke filtration material, such as cellulose acetate, and described in U.S. Pat. No. 4,185,645. Another alternative and commercially produced carbon filter is the ACT (Active Carbon Thread) Filter made by Filtrona UK, where the carbon in the centre section is adhered to a cotton thread and then surrounded by cellulose acetate. The carbon thread section offers the path of least resistance and the majority of the smoke passes through the carbon centre.

A disadvantage with these arrangements is that most, if not all, of the tobacco smoke is passed through that section of the filter element containing the carbon.

UK Patent Specification No. 1,410,048 sought to overcome the problems associated with carbon 'off-taste', a feature commonly found with carbon-containing filter cigarettes where all the smoke passes through the carbon section. There was therein discussed and filters were produced which comprised longitudinally extending regions separated by diaphragm(s) of vapour-porous material, one region comprising a flow path for smoke and one region containing carbon and being closed to smoke. FIG. 1 of that document is reproduced in the drawings hereof under the designation FIG. 1 (Prior Art). This embodiment shows a triple filter element having a filter section 1 comprised of two concentric tubes 5 and 6, inner tube 6 comprising highly vapour-porous paper (>1,000 Coresta Units) and outer tube 5 comprising a smoke-impervious wrapper. The annular space 7' is filled with carbon particles and the interior of the inner tube 6 is empty and forms a central smoke channel 7. The annular space 7' is blocked at both ends with impervious annular closures 8. At either end of filter section 1 are filter plugs 2 and 3 of cellulose acetate. In use, smoke is drawn through the smoke channel 7 without flowing through the carbon material. Volatile constituents are reduced owing to the diffusion of the volatile constituents of the smoke through the inner tube 6 into the carbon-filled annular space 7' in which they are absorbed. There is no carbon off-taste as the particulate matter of the smoke does not come into contact with the carbon material.

The filter section 1 of UK Patent Specification No. 1,410,048 was produced by sprinkling carbon granules over the whole of the inner surface of a plugwrap and wrapping the core element of the inner tube 6 with the carbon-treated plugwrap. These cut filter sections were then abutted, together with the annular disc blocking closure 8, to the end of filter plugs 2 and 3 in conventional triple filter manner.

A disadvantage with this arrangement is that it is difficult to produce such a filter which has the ends of the annular space blocked in a satisfactory manner and to assemble the multiple components at high production speeds.

Furthermore the filtration efficiency of conventional carbon-containing triple filters for vapour phase constituents is only of the order of about 20% for acetaldehyde and acrolein, for example.

SUMMARY OF THE INVENTION

The present invention seeks to provide a tobacco smoke filter element having a carbon section, which carbon section is not contacted by the particulate smoke phase, and which filter has a higher than normal filtration efficiency for the removal of vapour phase constituents.

DETAILED DESCRIPTION OF THE PREFERRED EMBODIMENTS OF THE INVENTION

Figure 1:
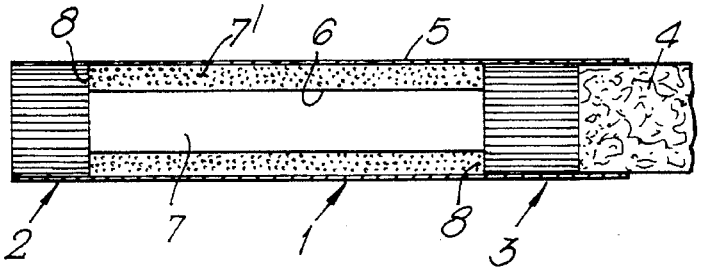
(PRIOR ART) Fig.1.
FIG. 1 (Prior Art) shows a filter element as described in FIG. 1 of UK Patent Specification No. 1,410,408, which is an equivalent of U.S. Pat. No. 3,894,545.

The present invention provides a smoking article having a rod of wrapped tobacco filler material and a tobacco smoke filter element, the filter element comprising a region comprising means to reduce the vapour phase constituents of tobacco smoke and a region extending lengthwise of the element and being a tobacco smoke flow path, the smoking article being provided with ventilation means, the arrangement of said ventilation means being such that, in use, the tobacco smoke is guided away from the region comprising means to reduce the vapour phase constituents of tobacco smoke, and vapour phase constituents of the smoke are able to diffuse into the region comprising means to reduce the vapour phase constituents of tobacco smoke.

Preferably the region being a tobacco smoke flow path is separate from the region comprising means to reduce the vapour phase constituents of tobacco smoke.

Advantageously the means to reduce the vapour phase constituents of tobacco smoke is an absorbent material, which material may suitably be carbon. The carbon may be granular and may be activated carbon. Other similar materials known to the skilled man may also be used.

Advantageously the region comprising means to reduce the vapour phase constituents of tobacco smoke extends as an annulus about the region extending lengthwise of the element and being a tobacco smoke flow path. Preferably the region comprising means to reduce the vapour phase constituent of tobacco smoke is uninterrupted in extent, although the region may comprise pockets of vapour phase constituents reducing means located in close proximity to one another. The region comprising means to reduce the vapour phase constituents of tobacco smoke may extend substantially the full length of the filter element and may be co-extensive with the region being a smoke flow path.

The tobacco smoke filter element may comprise discrete sections interattached to one another by a plugwrap, for example, or the filter element may be an integral unit. Advantageously, whatever the arrangement of the filter element, the region comprising means to reduce the vapour phase constituents of tobacco smoke may be located either at or towards that end of the filter element adjacent or closest to the rod of tobacco filler material. Such an arrangement may be a dual filter arrangement or an integral filter element.

In the alternative, the region comprising means to reduce vapour phase constituents may be located towards the centre of the filter element. Such an arrangement may be a triple filter arrangement or an integral filter element.

In a filter element according to the present invention and being comprised of discrete sections, and in a dual filter arrangement thereof, the section of the filter element comprising the region comprising means to reduce vapour phase constituents is preferably arranged as an annulus either surrounding tobacco smoke filtration material which may or may not be wrapped in a porous membrane, or surrounding an empty or substantially empty tubular cavity comprised of a porous membrane. The porous membrane is preferably only porous with respect to the vapour phase constituents of tobacco smoke.

In a dual or triple filter arrangement the pressure drop of the filtration material plugs may be varied.

As used herein the terms dual filter and triple filter mean filter elements comprising two or three distinct or discrete sections. However, filter elements according to the present invention may be of integral construction but have the general appearance of a dual or triple filter element.

The ventilation means may suitably comprise perforation holes in the tipping wrapper used to interattach the filter element and the rod of wrapped tobacco filler material.

Alternatively the ventilation means may be provided by the use of a porous tipping wrapper used in conjunction with a perforated plugwrap. The porous tipping wrapper may be porous over its full extent or over only a localised extent, which extent is in registration with the underlying perforated plugwrap.

In a further alternative, the ventilation means may be provided at or close to the end of the rod of wrapped tobacco filler material. The ventilation means may be provided in the tipping wrapper or in the cigarette paper wrapper enwrapping the tobacco filler material.

In a yet further alternative, the ventilation means may be provided at the location of a member situated between the filter element and the rod of wrapped tobacco filler material.

The ventilation means is preferably located at an upstream end of the filter element or to the upstream of the filter element. The ventilation means may be provided such that air passes through the region comprising means to reduce the vapour phase constituents of tobacco smoke to guide the smoke away from the said region, whilst still allowing diffusion of the vapour phase constituents into the said region.

Figure 2:
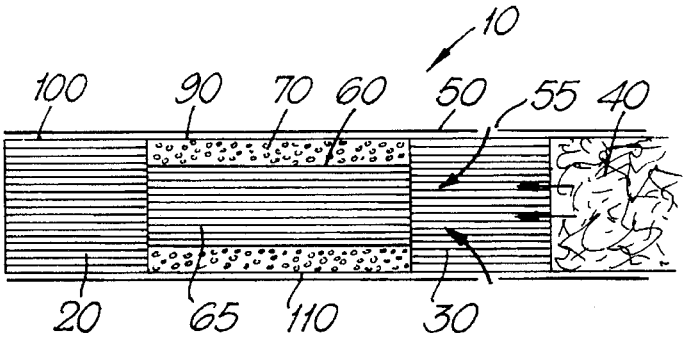
FIG. 2 shows in partial longitudinal cross-section a cigarette in accordance with the present invention and comprising a triple filter.

FIG. 2 of the drawings shows a cigarette 10 comprising a rod 40 of wrapped tobacco filler material and two end plugs 20 and 30 of cellulose acetate filtration material and a centre section 90 which together comprise a triple filter 100. The triple filter 100 is wrapped by a porous plugwrap 110. A region comprising means to reduce vapour phase constituents of tobacco smoke is centre section 90, which comprises an annulus 70 of carbon material adhered to the plugwrap 110 and a core 65 which is enwrapped in a porous membrane 60. The presence of porous membrane 60 is optional. The core 65 comprises cellulose acetate filtration material. The porous membrane 60 is porous to vapour phase constituents of tobacco smoke. The triple filter 100 is interattached to rod 40 of wrapped tobacco filler material by tipping wrapper 50. Tipping wrapper 50 is provided with ventilation means in the form of ventilation perforations 55. A region being a smoke flow path thus extends through end plug 30, core 65 and end plug 20.

The triple filter of cigarette 10 is commonly produced according to the method described above with respect to cigarettes of UK Patent Specification No. 1,410,048.

In use, as the cigarette is drawn upon, air is drawn into the filter element through the perforation holes 55 in end plug 30. The effect of this incoming air is to form a sheath of air around the smoke drawn from the rod 40 of wrapped tobacco filler. The smoke is thus guided through the core 65 of cellulose acetate. There is little or no contact of the particulate phase of the tobacco smoke with the carbon contained in annulus 70. Vapour phase constituents are able to diffuse into the carbon-containing annulus 70, where they are absorbed by the carbon. The smoke is channelled away from the carbon-containing annulus 70 whereby the carbon is not contaminated with the whole of the tobacco smoke and no carbon off-taste is imparted to the smoke following such contact. The degree of vapour phase reduction achieved by such a cigarette in common with all the cigarettes according to the present invention, has been found to be greater than the reduction which would be expected in view of the degree of ventilation to which the cigarette is subjected.

An embodiment which is not illustrated but which is very similar in construction and operation to that shown in FIG. 2, is a cigarette which has a centre section in which the core is empty and comprises a tube of vapour phase porous membrane. The region being a smoke flow path thus extends through filtration material in end plug 30, an empty cavity in core 65 and further filtration material in end plug 20.

Figure 3:
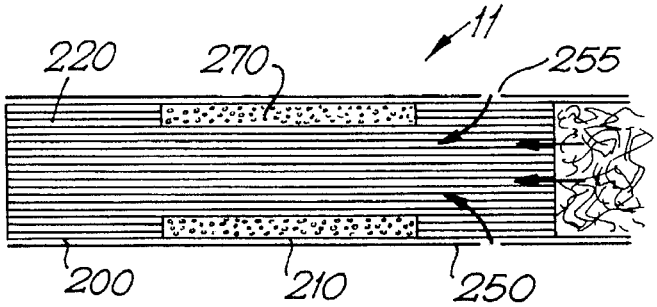
FIG. 3 shows in partial longitudinal cross-section a cigarette in accordance with the present invention and comprising an integral filter element.

The cigarette 11 depicted in FIG. 3 comprises an integral filter element 200. The filter element 200 comprises a tobacco smoke filtration material 220 over a central portion of which is provided an annulus 270 of carbon material which material is adhered in strips arranged transversely to the length of plugwrap 210. A tipping wrapper 250 is provided with ventilation perforations 255.

In use the cigarette 11 operates in an identical manner to the cigarette of FIG. 1, the smoke being constrained to flow along the centre of the filter element.

Figure 4:
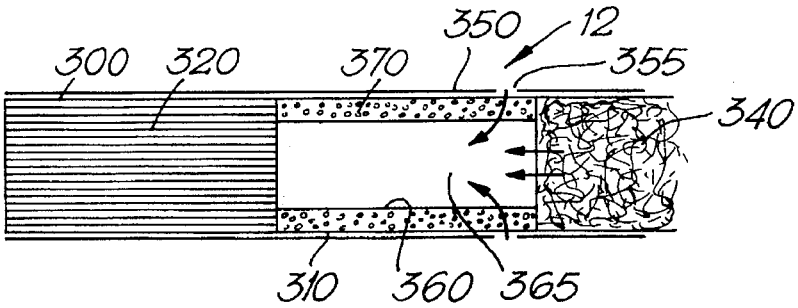
FIG. 4 shows in partial longitudinal cross-section a cigarette, in accordance with the present invention and comprising a dual filter.

FIG. 4 shows a further embodiment in which the cigarette 12 is provided with a dual filter element 300. An end plug 320 of cellulose acetate filtration material is located at the mouthend or downstream end of the cigarette 12. Abutting the rod 340 of wrapped tobacco filler material is an end section comprising an annulus 370 of carbon material adhered to a plugwrap 310. The core 365 is an empty cavity formed by a tube 360 of vapour phase porous membrane. A tipping wrapper 350 interattaching the rod 40 of wrapped tobacco filler material has perforation holes 355 which allow the ingress of ventilating air through the carbon in annulus 370 to channel the smoke, upon draw, along a smoke flow path which does not contact the carbon in annulus 370. Diffusion outwardly of the vapour phase constituents still occurs into the carbon-containing annulus 370, where the vapour phase constituents are absorbed by the carbon. The core 365 may, in the alternative, be filled with filtration material.

Figure 5:
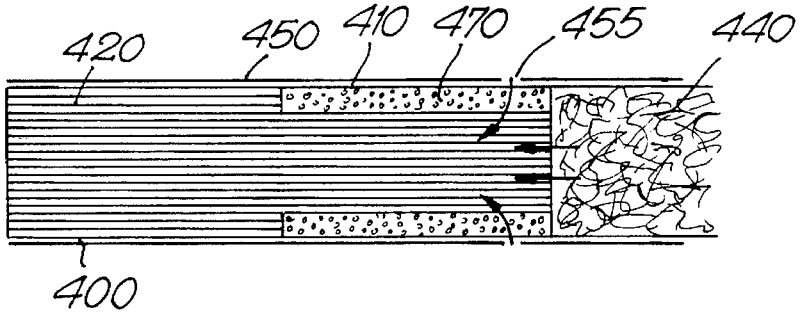
FIG. 5 shows in partial longitudinal cross-section a cigarette in accordance with the present invention and comprising an integral filter element.

An embodiment very similar to alternative version of FIG. 4 is that depicted in FIG. 5. An annulus 470 of carbon material which is adhered to the plugwrap 410 is wrapped around filtration material 420, such as cellulose acetate, of filter element 400. Filter element 400 is an integral element. Filter element 400 is interattached by tipping wrapper 450 to rod 440 of wrapped tobacco filler material and is provided with ventilation perforations 455 located at or close to the interface with the rod 440 and filter element 400.

In use, smoke is channelled into the centre of the filter element 400 by ventilating air entering the filter element 400 through the annulus 470 of carbon. Outward diffusion of the vapour phase constituents still occurs into the carbon, despite inward passage of ventilation air.

Figure 6:
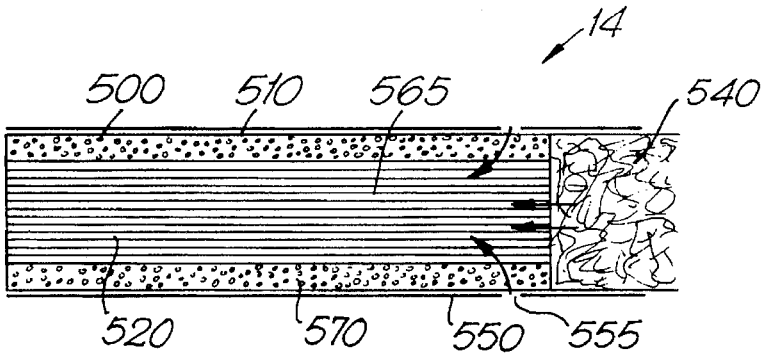
FIG. 6 shows in partial longitudinal cross-section a cigarette in accordance with the present invention.

FIG. 6 shows a cigarette 14 having an integral filter element 500 comprising a core of filtration material 520 wrapped in a plugwrap 510 to which is adhered, over the full undersurface of the plugwrap, carbon material. An annulus 570 of carbon-containing material extending lengthwise of the filter element is formed about the core 565 of filtration material 520. Ventilating air ingresses the filter element 500 through ventilation perforations 555 provided in tipping wrapper 550. A sheath of ventilating air is thus provided about the smoke from rod 540 whereby contact of the smoke with the carbon is prevented and diffusion outwardly into the annulus 570 can occur of vapour phase constituents.

Figure 7:
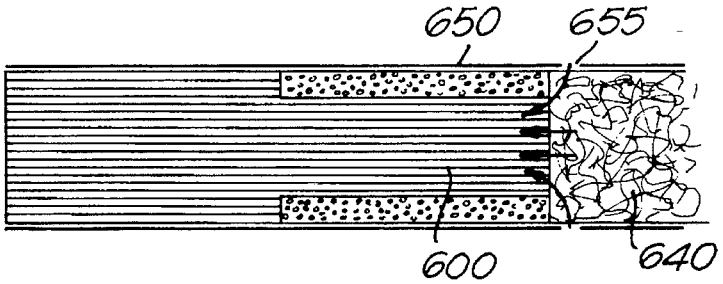
FIG. 7 shows in partial longitudinal cross-section a cigarette in accordance with the present invention and comprising an integral filter element.

The embodiment of FIG. 7 is identical to the embodiment of FIG. 5, with the exception that the ventilation perforations 655 in tipping wrapper 650 are located upstream of the junction or interface between the rod 640 of tobacco filler material and filter element 600. A sheath of ventilating air constricts the smoke to the centre of the filter element 600.

Figure 8:
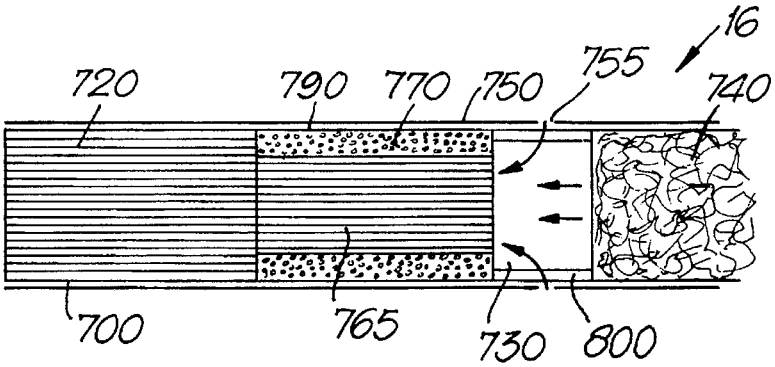
FIG. 8 shows in partial longitudinal cross-section a cigarette in accordance with the present invention and comprising a dual filter and a further tubular member in a triple filter arrangement.

Finally, FIG. 8 shows a cigarette 16 comprising a rod 740 of tobacco filler material and a filter element 700 comprised of a triple filter having an end plug 720 of cellulose acetate filtration material, a centre section 790 having an annulus 770 of carbon material and a core 765 of cellulose acetate filtration material wrapped in a vapour phase porous membrane 760, and a tubular end section 730 of air permeable material 800. Ventilation perforations 755 in tipping wrapper 750 are located over the end section 730.

In order to provide quantitative evidence of the operation of these inventive cigarettes, the following cigarettes were made.

Four types of cigarette were produced of conventional circumference, i.e. about 24.5 mm. Included in these four types were cigarettes having conventional cellulose acetate filter elements, cigarettes having conventional carbon-containing triple filter elements, cigarettes having an alternative carbon-containing filter element and cigarettes according to the present invention. Table 1 below outlines the manufacturers' specifications of the filters. (The figures given in brackets are the pressure drop figures actually measured).

TABLE 1

Manufacturers' Specifications of Filters

| Code | ACT-hi | ACT-lo | ACS-hi | ACS-lo | ACS-tube | Triple | CA |
|---|---|---|---|---|---|---|---|
| Triple Filter Configuration (mm) | 6 + 12 + 6 | 6 + 12 + 6 | 6 + 12 + 6 | 6 + 12 + 6 | 6 + 12 + 6 | 9 + 6 + 9 | 24 |
| Materials | NWA + ACT + NWA | NWA + ACT + NWA | NWA + ACS + NWA | NWA + ACS + NWA | NWA + ACS + NWA | NWA + CAV + NEA | CA |
| Circumference | 24.49 | 24.51 | 24.55 | 24.47 | 24.44 | 24.51 | 24.55 |
| Tobacco Rod Length (mm) | 76 | 76 | 76 | 76 | 76 | 76 | 120 |
| Tobacco Rod PD (mm Wg) | 336 | 338 | 372 | 324 | 336 | 389 | 420 |
| Filter PD | 84 (81) | 84 (84) | 91 (89) | 86 (80) | 84 (80) | 97 (95) | 84 (81) |

TABLE 1-continued

| Code | ACT-hi | ACT-lo | ACS-hi | ACS-lo | ACS-tube | Triple | CA |
|---|---|---|---|---|---|---|---|
| | Manufacturers' Specifications of Filters | | | | | | |
| (mm Wg) | | | | | | | |
| Segment PD (mm Wg) | 33 + 20 + 33 (31 + 20 + 30) | 35 + 14 + 35 (32 + 20 + 32) | 31 + 21 + 31 (35 + 19 + 35) | 33 + 14 + 33 (33 + 11 + 36) | 37 + 0 + 34 (41 + 0 + 39) | 43 + 0 + 52 (43 + 0 + 52) | 84 (81) |
| Carbon/Filter weight (mg) | 64 | 73 | 61 | 66 | 62 | 55 | 0 |
| Surface area/tip ($m^2$) | 56 | 68 | 52 | 50 | 48 | 56 | 0 |

NWA = non-wrapped acetate
ACS = adsorbent coated sheath
ACT = adsorbent coated thread
CA = cellulose acetate
CAV = cavity For comparison purposes the four types of cigarette included two sets of cigarettes having ACT filter elements as described hereinabove, where carbon is present attached to threads which extend through the core of the filter element centre section. One set of these cigarettes had a higher pressure drop section than the other set of cigarettes, hence they were known as 'ACT-hi' and the other set of cigarettes were known as 'ACT-lo'.

Three cigarettes were produced of the type according to the invention. These cigarettes had ACS filter elements, where carbon is present as a strip surrounding a central core section. Cigarettes having a higher pressure drop centre section were produced and were known as 'ACS-hi'. Cigarettes having a lower pressure drop centre section were produced and were known as 'ACS-lo'. Cigarettes having a centre section with a coaxially extending tube of 2.5 mm internal diameter were also produced. These cigarettes were known as 'ACS-tube'. The ACS-type cigarettes were of a constructional arrangement like that shown in the embodiment of FIG. 2.

Figure 9:
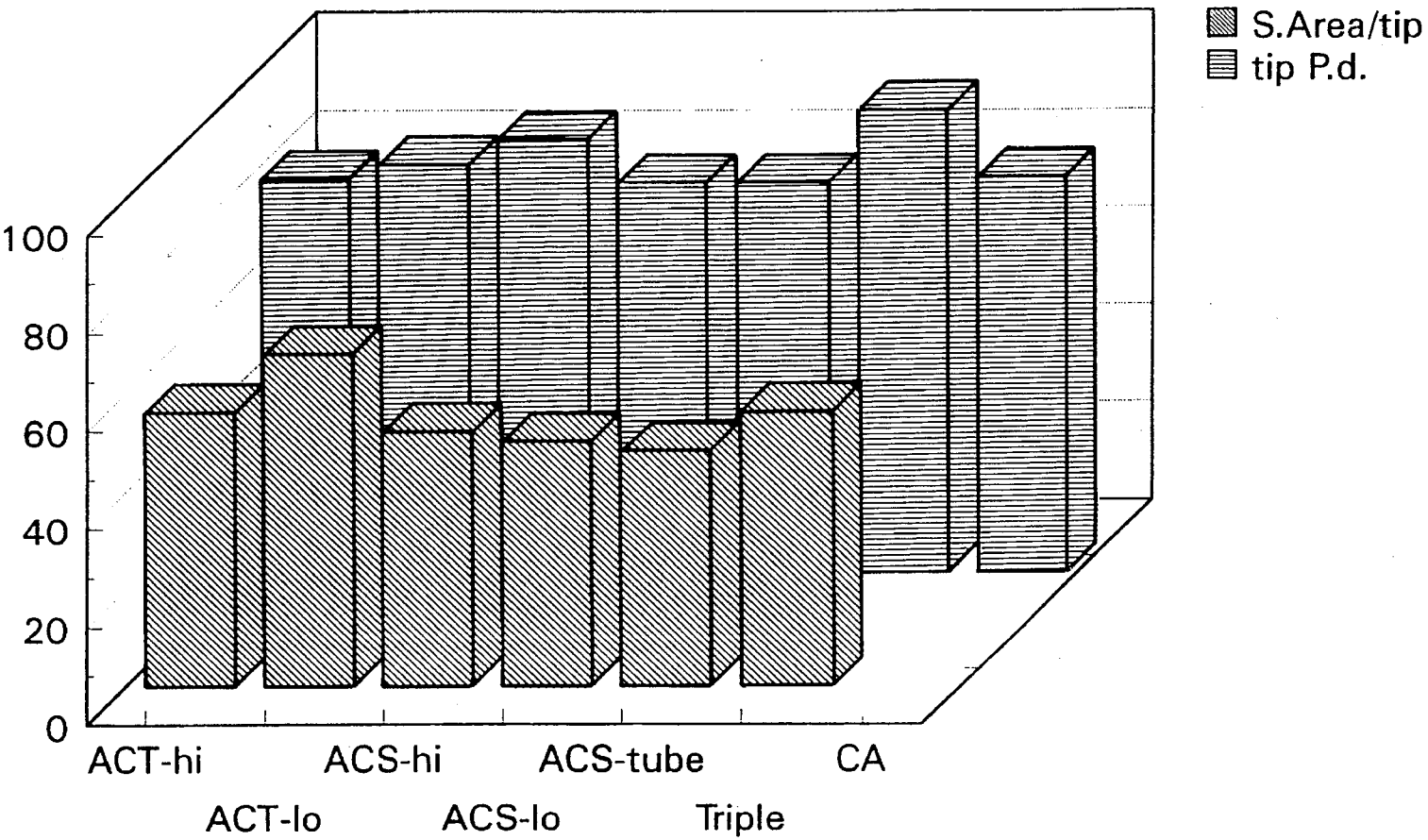
FIG. 9 shows the surface area/tip and tip pressure drop as a bar chart of cigarettes selected for comparison with cigarettes according to the present invention.

FIG. 9 shows the surface area/tip and tip pressure drop (P.d) of the cigarettes as a bar chart. It can be seen that the cigarettes were generally well matched in forms of similarity of these parameters. This ensures that the tar delivery of each type of cigarette is similar. The carbon activity of each type of cigarette was also matched, as was the amount of smoke, and hence tar, flowing through the carbon sections of the filter elements.

These seven cigarettes were smoked on a smoking machine under standard machine smoking conditions of one puff of 2 seconds duration and 35 $cm^3$ volume taken at a frequency of one a minute. The basic smoke deliveries obtained from the mainstream smoke of the unventilated cigarettes are given in Table 2 below.

TABLE 2

| | SMOKE DELIVERIES OF UNVENTILATED CIGARETTES | | | |
|---|---|---|---|---|
| | Tar (mg) | Nicotine (mg) | Water (mg) | Puff No. |
| ACT-hi | 14.6 | 1.24 | 3.2 | 8.7 |
| ACT-lo | 13.3 | 1.21 | 3.0 | 8.7 |
| ACS-hi | 12.1 | 1.06 | 2.5 | 8.9 |
| ACS-lo | 13.3 | 1.23 | 2.8 | 8.9 |
| ACS-tube | 16.8 | 1.33 | 4.0 | 8.8 |
| Triple | 14.4 | 1.22 | 3.9 | 8.9 |
| CA | 13.2 | 1.13 | 1.9 | 8.5 |

Figure 10:
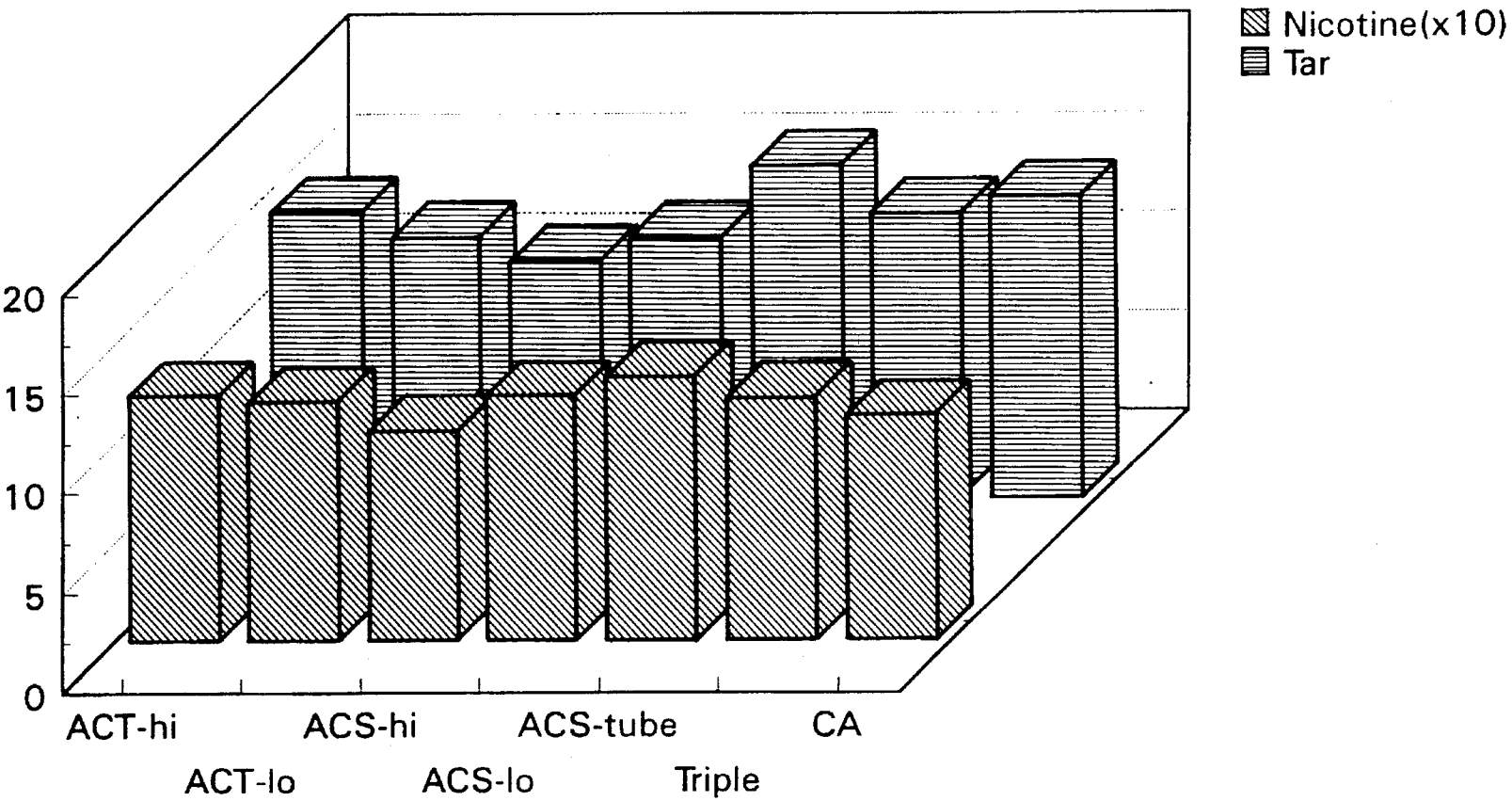
FIG. 10 shows the basic smoke deliveries of nicotine and tar as a bar chart for the unventilated cigarettes of FIG. 9.

FIG. 10 shows the basic smoke deliveries of nicotine and tar for the unventilated cigarettes in a bar chart. It can be seen from the bar chart that the tar and nicotine deliveries of the ACT- and ACS-type cigarettes are affected, even though the total filter element pressure drop for each type of cigarette remains very similar. It is thought that the difference in tar and nicotine deliveries for the ACT- and ACS-type filter elements is, however, effected by different mechanisms.

A further set of seven cigarettes were provided with laser perforations in the tipping wrapper 20 mm from the mouth end of the filter elements, resulting in a 30% ventilation level. These perforated cigarettes were smoked under standard smoking conditions and the basic smoke deliveries obtained from those cigarettes are recorded in Table 3 below.

TABLE 3

| | SMOKE DELIVERIES OF VENTILATED CIGARETTES | | | |
|---|---|---|---|---|
| | Tar (mg) | Nicotine (mg) | Water (mg) | Puff No. |
| ACT-hi | 10.9 | 1.04 | 0.8 | 9.4 |
| ACT-lo | 11.7 | 1.18 | 0.9 | 9.4 |
| ACS-hi | 10.2 | 0.96 | 0.6 | 9.3 |
| ACS-lo | 10.9 | 1.07 | 0.7 | 9.3 |
| ACS-tube | 12.2 | 1.11 | 0.9 | 9.1 |
| Triple | 11.6 | 1.09 | 1.0 | 9.2 |
| CA | 10.7 | 1.0 | 0.5 | 9.4 |

Figure 11:
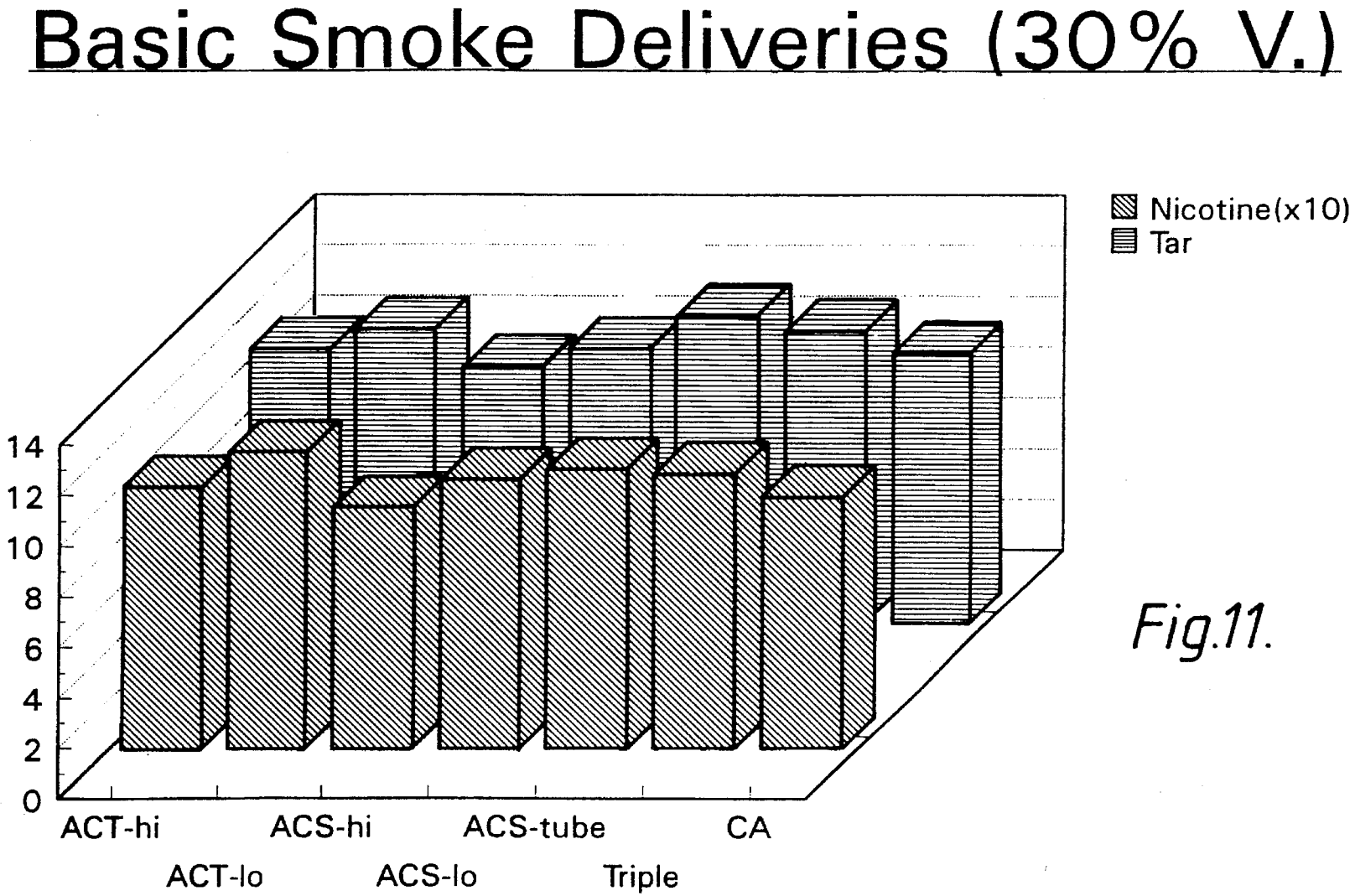
FIG. 11 shows the nicotine and tar deliveries of the cigarettes of FIG. 10 with 30% ventilation.

FIG. 11 shows, in bar chart form, the nicotine and tar deliveries of the 30% ventilated cigarettes. Ventilation channels the smoke through the central portion of each of the filter elements. A correspondingly lower delivery of tar and nicotine for all the cigarettes is seen.

Tables 2 and 3 both show that the deliveries obtained with cigarettes according to the invention are similar to the deliveries obtained with conventional cellulose acetate and triple filters in ventilated and unventilated condition.

Measurements of the acetaldehyde and acrolein deliveries from the mainstream smoke were made for both unventilated and ventilated cigarettes. The mean value of the measurements obtained are outlined in Table 4 below as a mean filtration efficiency for both acetaldehyde and acrolein combined.

TABLE 4

| Means of acetaldehyde and acrolein filter efficiencies | | | |
|---|---|---|---|
| Filter | Filter Efficiency (%) | Reduction due to Ventilation | Overall Reduction (%) |
| ACT-hi | 20.2 | 35.1 | 47.9 |
| ACT-lo | 27.1 | 30.7 | 49.4 |
| ACS-hi | 17.2 | 38.5 | 48.9 |
| ACS-lo | 16.2 | 34.6 | 44.9 |
| ACS-tube | 14.8 | 21.5 | 33.1 |
| Triple | 15.8 | 22.3 | 34.6 |
| CA | 1.0 | 28.5 | 29.2 |

It can be seen that the filtration efficiencies of the ACT and ACS filter types are generally higher than the filtration efficiencies of the conventional triple filter and cellulose acetate filter elements. In the case of the ACT filter elements, the higher efficiency is thought to be due to most of the smoke passing through the carbon section. However, it can also be seen that the reduction due to ventilation is higher for the ACS-hi and ACS-lo filter elements than for the ACT-hi and ACT-lo filter elements. It is believed that the reduction due to ventilation in the case of the ACT filters is due solely to dilution. However, it is also believed that the enhanced reduction due to ventilation for the ACS-hi and ACS-lo filter elements is actually due to additional diffusion of the mainstream smoke from the axis of the centre section outwardly to the peripherally surrounding carbon area, where further reduction in vapour phase occurs.

The overall reduction is based upon the reduction achieved with respect to the measurements of a non-filter tipped, i.e. plain, tobacco rod. It represents the reduction achieved due to both filtration and ventilation.

Figure 12:
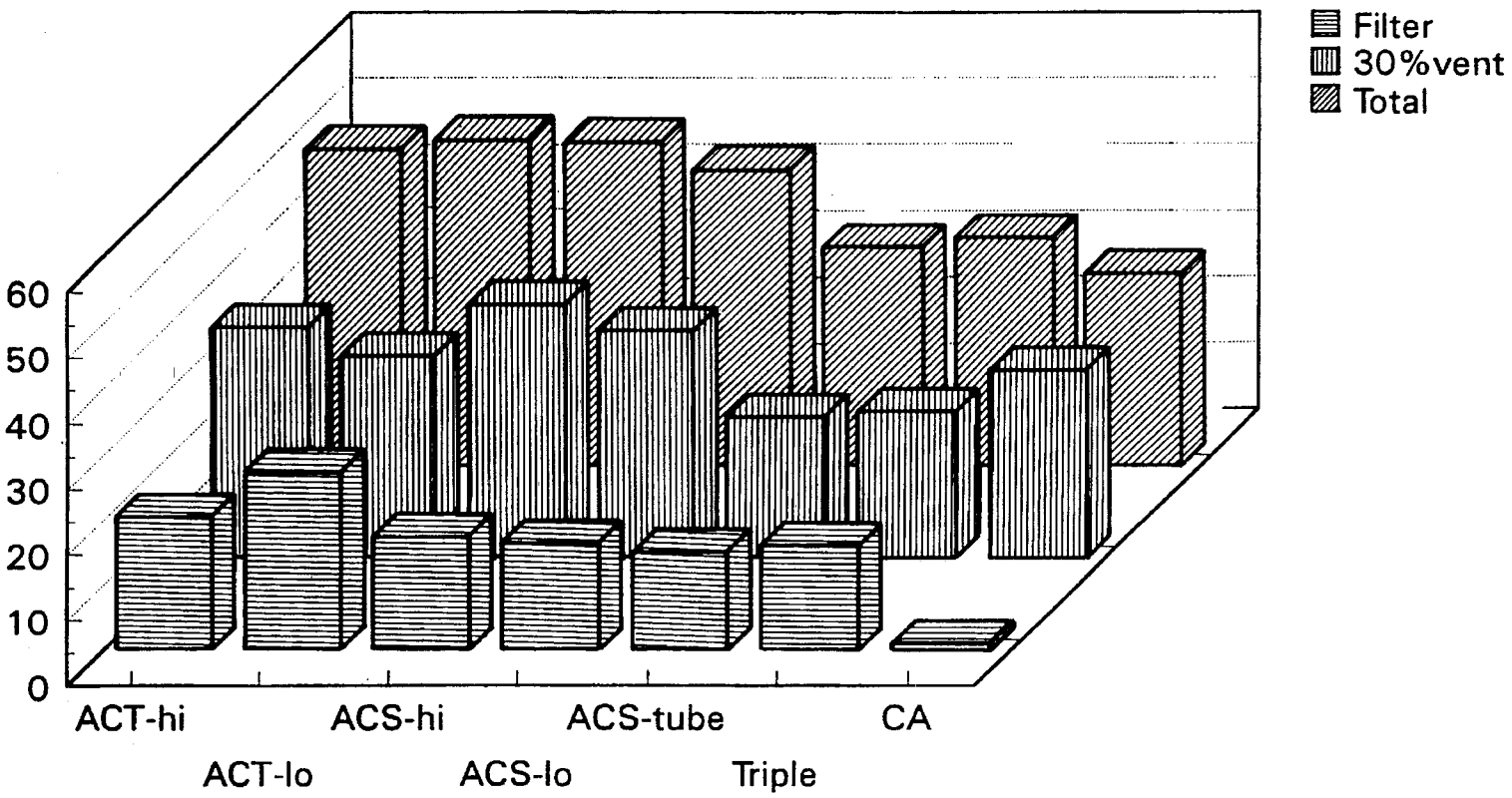
FIG. 12 depicts the mean of the acetaldehyde and acrolein efficiencies of the cigarettes of FIG. 9.

The mean of the acetaldehyde and acrolein efficiencies are shown in bar chart form as the filtration efficiency of the unventilated filter elements (filter), the reduction due to ventilation (30% vent) and the overall reduction achieved (total) in FIG. 12.

Figure 13:
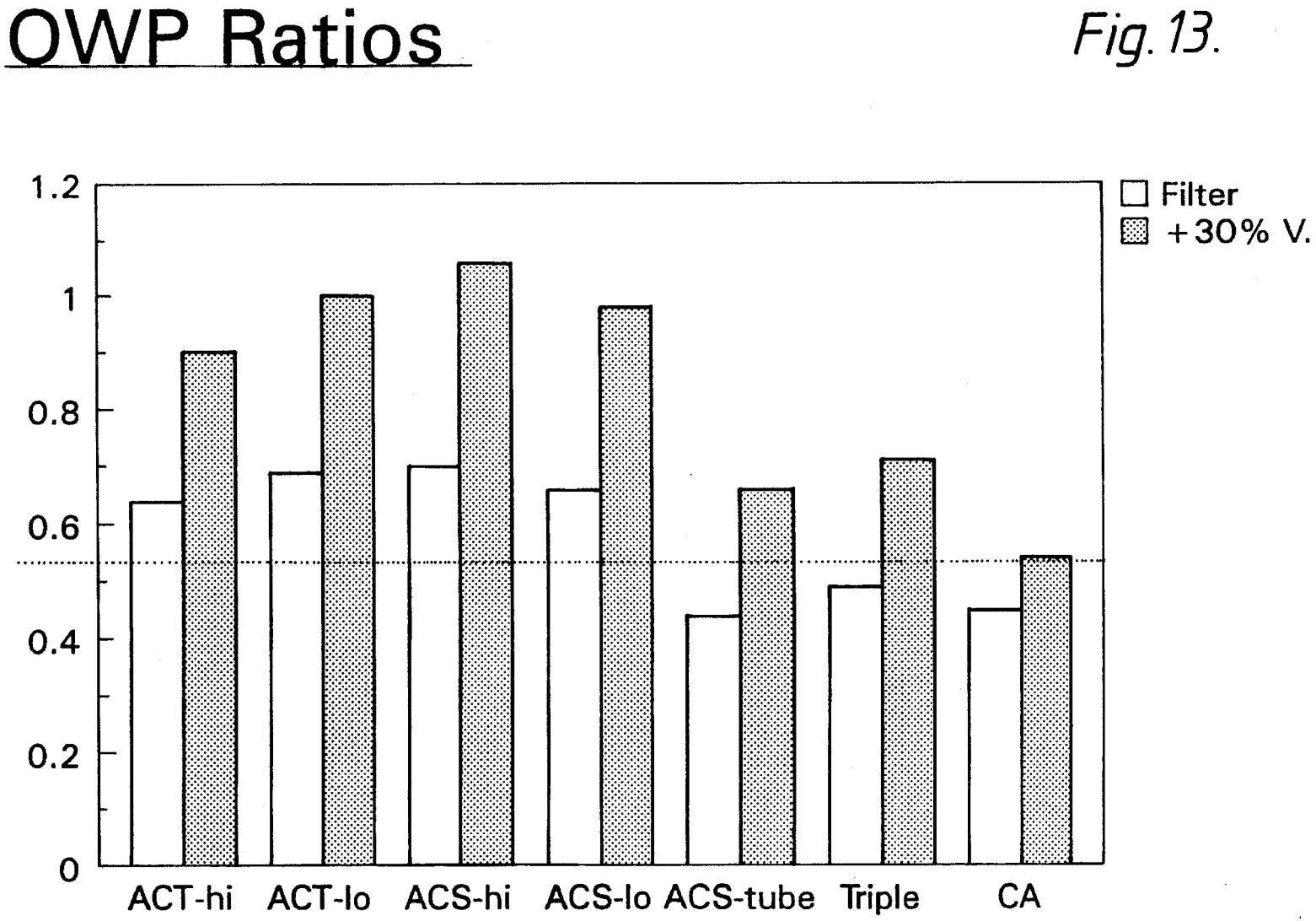
FIG. 13 depicts the oil water partition ratio for the cigarettes of FIG. 9.

As well as being able to obtain information regarding the particulate and vapour phases of the tobacco smoke from the seven different cigarettes, it was also thought to be useful to examine the semi-volatile components of the smoke. Conventionally this has been done by measuring the oil water partition ratio (OWP ratio). The OWP ratios obtained for all of the cigarettes are shown in FIG. 13 for both ventilated and unventilated cigarettes.

Figure 14:
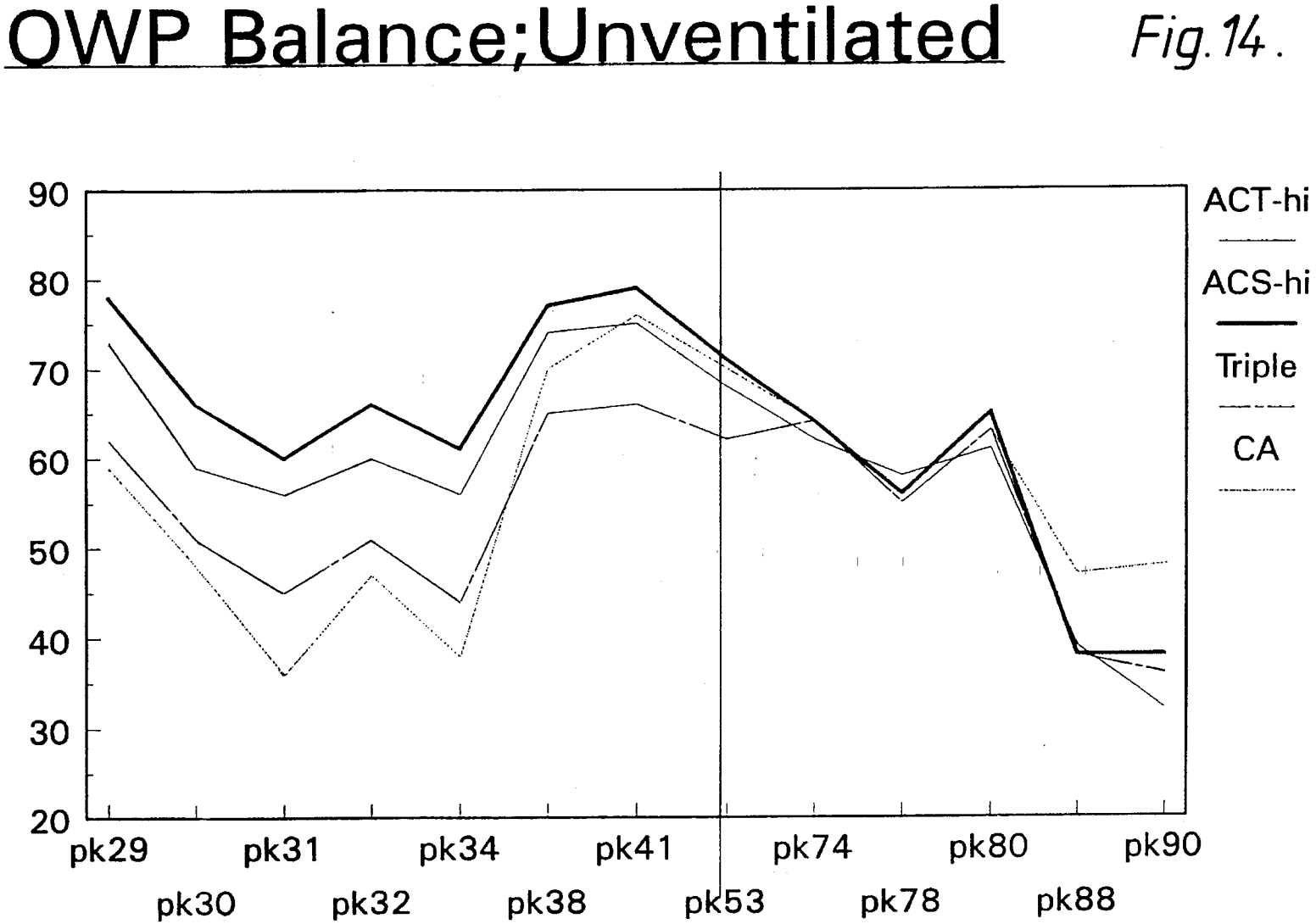
FIG. 14 depicts a packed column gas chromatograph vapour phase scan of four of the unventilated cigarettes of FIG. 9.

A further investigation of the compounds detected by the OWP scan was carried out. Comparisons of the OWP scan for a cigarette having a conventional triple filter element and a cigarette having a conventional cellulose acetate filter element were made with the OWP scans for ACT-hi cigarette and the ACS-hi cigarette. FIG. 14 is a plot of the peak number of a packed column gas chromatograph vapour phase scan against the percentage decrease in peak height for each of the four cigarettes (compared with the peak height of the scan from a plain tobacco tod). It can be seen in FIG. 14 that for all four cigarettes the pattern in peak height reduction is very similar for unventilated cigarettes.

Figure 15:
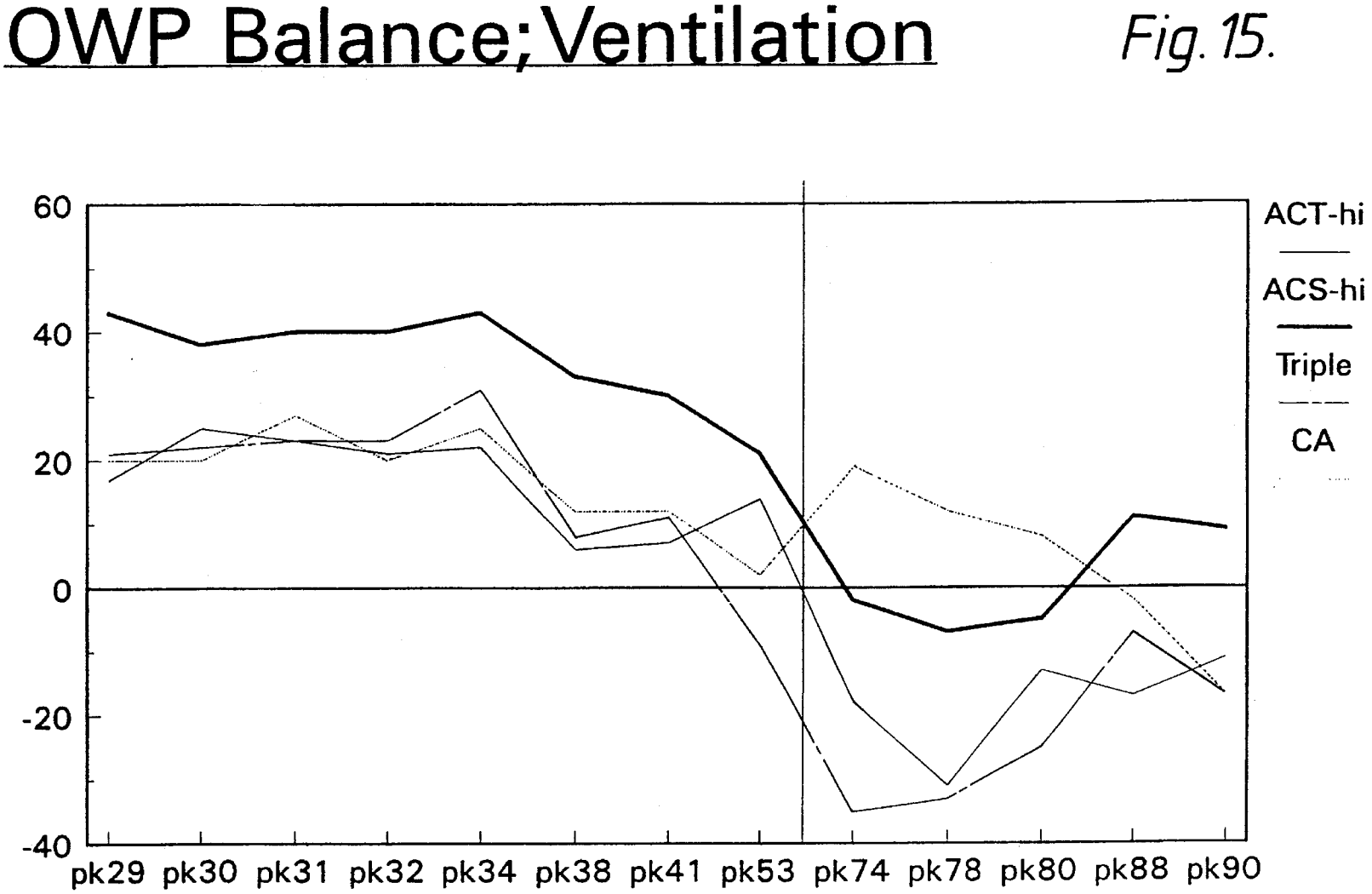
FIG. 15 depicts a plot of the further percentage reduction of peak heights of the scan of FIG. 14.

FIG. 15 plots the peak number of a gas chromatograph scan against a further percentage reduction in peak height over the OWP scan for a particular peak number of the non-ventilated cigarettes seen in FIG. 14.

However, FIG. 15 shows that when the four cigarettes are ventilated (30% ventilation level) there is a fairly close correlation in pattern for the lower peak numbers of the scan for the ACT-hi, triple and CA filter elements. The ACS filter element also reflects this pattern for the lower peak numbers of the scan but with an even bigger reduction in OWP peak height being observed.

At peaks above 70, i.e. the phenolic compounds, the ACT-hi and triple filters behave in a very similar fashion and diverge considerably from the behaviour exhibited by conventional CA filters.

In contrast, the OWP peak heights of the ACS-hi filter cigarettes, whilst not following exactly the CA trend, are less affected by ventilation than the ACT-hi and triple filter cigarettes and are closer to CA filter OWP ratios than the ACT-hi and triple filter cigarettes.

Cigarettes according to the present invention thus exhibit overall reductions in mean acetaldehyde and acrolein values which are similar to the reductions obtainable using ACT filter cigarettes, and which are significantly greater than the reductions in mean acetaldehyde and acrolein values for conventional triple filters. However, the balance of compounds indicated by the OWP peak heights for cigarettes according to the invention are such as to have positive implications for the cigarette designer in terms of the taste and flavour characteristics experienced by the smoker in view of the greater affinity with CA filter elements at higher peak numbers.

I claim:

1. A smoking article having a rod of wrapped tobacco filler material and a tobacco smoke filter element, the filter element comprising;

(a) a first region comprising means to reduce the vapour phase constituents of tobacco smoke, said first region being an annulus of vapour phase reducing materials adhered to a wrapper and being devoid of end blocking means for blocking flow through the ends of the first region; and (b) a separate second region extending lengthwise of the filter element and being a tobacco smoke flow path; said smoking article having ventilation means located for channelling tobacco smoke into the tobacco smoke flow path and away from the first region comprising means to reduce the vapour phase constituents of tobacco smoke, thereby negating the requirement for end-blocking means at the annulus of vapour phase reducing material, and vapour phase constituents of the smoke being able to diffuse into the first region comprising means to reduce the vapour phase constituents of tobacco smoke.

2. A smoking article according to claim 1, wherein the means to reduce the vapour phase constituents of tobacco smoke is an absorbent material.

3. A smoking article according to claim 2, wherein said absorbent material is carbon.

4. A smoking article according to claim 3, wherein the carbon is activated carbon.

5. A smoking article according to claim 1, wherein the region comprising means to reduce the vapour phase constituents of tobacco smoke extends about the central part of the region extending lengthwise of said filter element and being a tobacco smoke path.

6. A smoking article according to claim 1, wherein the region comprising means to reduce the vapour phase constituents of tobacco smoke extends substantially the full length of the filter element.

7. A smoking article according to claim 1, wherein the region comprising means to reduce the vapour phase constituents of tobacco smoke is located at or towards that end of said filter element adjacent or closest to the rod of tobacco filler material.

8. A smoking article according to claim 1, wherein the region comprising means to reduce the vapour phase constituents of smoke is located towards the centre of said filter element.

9. A smoking article according to claim 1, wherein said tobacco smoke filter element comprises discrete sections interattached to one another by a plugwrap.

10. A smoking article according to claim 1, wherein said tobacco smoke filter element is an integral unit.

11. A smoking article according to claim 1, wherein said ventilation means is located at or close to an upstream end of said filter element.

12. A smoking article according to claim 6, wherein ventilation means is provided such that air passes through the region comprising means to reduce the vapour phase constituents of tobacco smoke to guide the smoke away from the said region, whilst still allowing diffusion of the vapour phase constituents into the said region.

13. The article of claim 1 wherein the tobacco smoke flow path region is wrapped in a wrapper and the vapor phase reducing material is adhered to said wrapper.

* * * * *

UNITED STATES PATENT AND TRADEMARK OFFICE

CERTIFICATE OF CORRECTION

PATENT NO. : 5,549,125

DATED : August 27, 1996

INVENTOR(S) : Peter R. White

It is certified that error appears in the above-indentified patent and that said Letters Patent is hereby corrected as shown below:

Col. 2, line 34; "1,410,408" should read -- 1,410,048 -- .

Col. 4, between lines 37 and 38; insert the following:

-- Figure 1 is described in detail above with respect to the prior art -- .

Cols. 5 and 6, Table 1, under column marked "Triple", line 4; "NEA" should read -- NWA -- .

Col. 9, line 57; "tod" should read -- rod -- .

Signed and Sealed this

Eighteenth Day of February, 1997

*Attest:*

Bruce Lehman

BRUCE LEHMAN

*Attesting Officer*

*Commissioner of Patents and Trademarks*